US006166652A

United States Patent [19]

Benvenuti

[11] Patent Number: 6,166,652

[45] Date of Patent: Dec. 26, 2000

[54] SYSTEM AND METHOD FOR LOCATING MISPLACED ITEMS

[76] Inventor: Kerrie Benvenuti, 1704 Newport Hills Dr. West, Newport Beach, Calif. 92660

[21] Appl. No.: 09/102,405

[22] Filed: Jun. 22, 1998

Related U.S. Application Data

[60] Provisional application No. 60/050,536, Jun. 23, 1997.

[51] Int. Cl.[7] ..... G08B 5/22

[52] U.S. Cl. ..... 340/825.49; 340/825.36; 379/102.01; 455/419

[58] Field of Search ..... 340/825.49, 571, 340/539, 825.44, 825.36; 341/173; 455/567, 419, 515, 68; 379/373, 102.01, 106.01; 381/105

[56] References Cited

U.S. PATENT DOCUMENTS

| | | | |
|---|---|---|---|
| 3,825,833 | 7/1974 | Bogue et al. | 325/119 |
| 4,101,873 | 7/1978 | Anderson et al. | 340/539 |
| 4,476,469 | 10/1984 | Lander | 340/825.49 |
| 4,507,653 | 3/1985 | Bayer | 340/539 |
| 4,595,922 | 6/1986 | Cobb et al. | 340/825.49 |
| 4,818,973 | 4/1989 | Yamakawa et al. | 340/572 |
| 4,922,229 | 5/1990 | Guenst | 340/572 |
| 4,935,735 | 6/1990 | DeLuca et al. | 340/825.44 |
| 5,570,081 | 10/1996 | Holstrom | 340/573 |
| 5,576,692 | 11/1996 | Tompkins | 340/571 |
| 5,629,677 | 5/1997 | Staino, Jr. | 340/568 |
| 5,638,050 | 6/1997 | Sacca et al. | 340/571 |
| 5,812,056 | 9/1998 | Law | 340/539 |
| 5,933,090 | 8/1999 | Christenson | 340/825.69 |

FOREIGN PATENT DOCUMENTS

| | | |
|---|---|---|
| 0089 667 | 9/1983 | European Pat. Off. . |
| 0177 068 | 4/1986 | European Pat. Off. . |
| 2181919 | 4/1987 | United Kingdom . |

*Primary Examiner*—Michael Horabik
*Assistant Examiner*—Matsuichiro Shimizu
*Attorney, Agent, or Firm*—Knobbe, Martens, Olson & Bear, LLP

[57] ABSTRACT

A system for locating lost keys or other items includes a compact, pocket-sized unit that includes a key chain. The unit includes a sound generator that generates a sound of sufficient volume to facilitate locating the device from a distance. The sound generator is coupled to a beeper circuit to allow the operator to actuate the sound generator by placing a telephone call to a beeper or other service. The unit also acts as a conventional beeper for allowing the user to receive messages. Herein, a beeper is defined to include pagers and any other portable device that can be activated by a user placing a telephone call. Using a voice menu, the caller can control the volume of the audible signal generated by the sound generator and/or the duration of the sound-generation event. The operator can also activate a flashing light of the compact unit. Various optional features may be included within the unit, including a miniature flashlight (useful for locating a key hole), a "panic" button that activates the sound generator at is highest volume setting, and a transmitter for opening door locks and/or opening a garage door.

1 Claim, 3 Drawing Sheets

SYSTEM AND METHOD FOR LOCATING MISPLACED ITEMS

PRIORITY CLAIM

This application claims the benefit of U.S. Provisional Application No. 60/050,536 filed Jun. 23, 1997, entitled "System and Method for Locating Lost Keys."

BACKGROUND OF THE INVENTION

Systems for aiding an operator to locate missing items are known in the art. One such system is attached to the commonly misplaced item and reacts, for example, to clapping from the operator, by emitting an audible alarm which helps the operator locate the system and the attached misplaced item.

One problem with this type of system is that the activation range is confined by the sensitivity of the detector to clapping and the ability of the operator to make a sufficiently loud and distinct clap. This range is further limited because the detector of such a system must be able to distinguish between steady background noise and the clap of the operator.

In addition, systems of this type are susceptible to misfiring caused by false or unintended stimuli. For example, the system might react to the clapping of others or the hammering of a nail. Such false alarms can be annoying to the operator and others.

A system and method for locating misplaced items are needed that, among other things, have a large activation range; a distinct activation signal that is independent of, although initiated by, the operator; and the effectiveness to differentiate between its activation signal and false signals or noise.

SUMMARY OF THE INVENTION

A system for locating lost keys or other items includes a compact, pocket-sized device that includes a key chain. The device includes a sound generator that generates a sound of sufficient volume to facilitate locating the device and the misplaced item from a distance. The sound generator is coupled to a beeper circuit to allow the operator to activate the sound generator by placing a telephone call to a beeper or other service. Herein, a beeper is defined to include pagers and any other portable device that can be activated by a user placing a telephone call. Using a voice menu, the caller can control the volume of the audible signal generated by the sound generator and/or control the duration of the sound-generation event. In one embodiment, the operator can also activate a flashing light of the compact device. The device also preferably acts as a conventional beeper for allowing the user to receive messages.

The device preferably uses a conventional beeper receiver to receive control signals over a pre-existing communications network. Using beeper technology takes advantage of existing components and the existing transmitting station networks, and provides an activation range equal to that of existing beeper services. In addition, the use of such technology reduces the likelihood of false or unintentional activations.

The device may also include one or more of the following: a miniature flashlight for finding a keyhole, a "panic" button that immediately activates the sound generator at its highest volume setting, a transmitter for opening a garage door and/or a car door lock, a voice dictation system, and a system for storing and accessing personal medical information.

DETAILED DESCRIPTION OF THE PREFERRED EMBODIMENT

Figure 1:
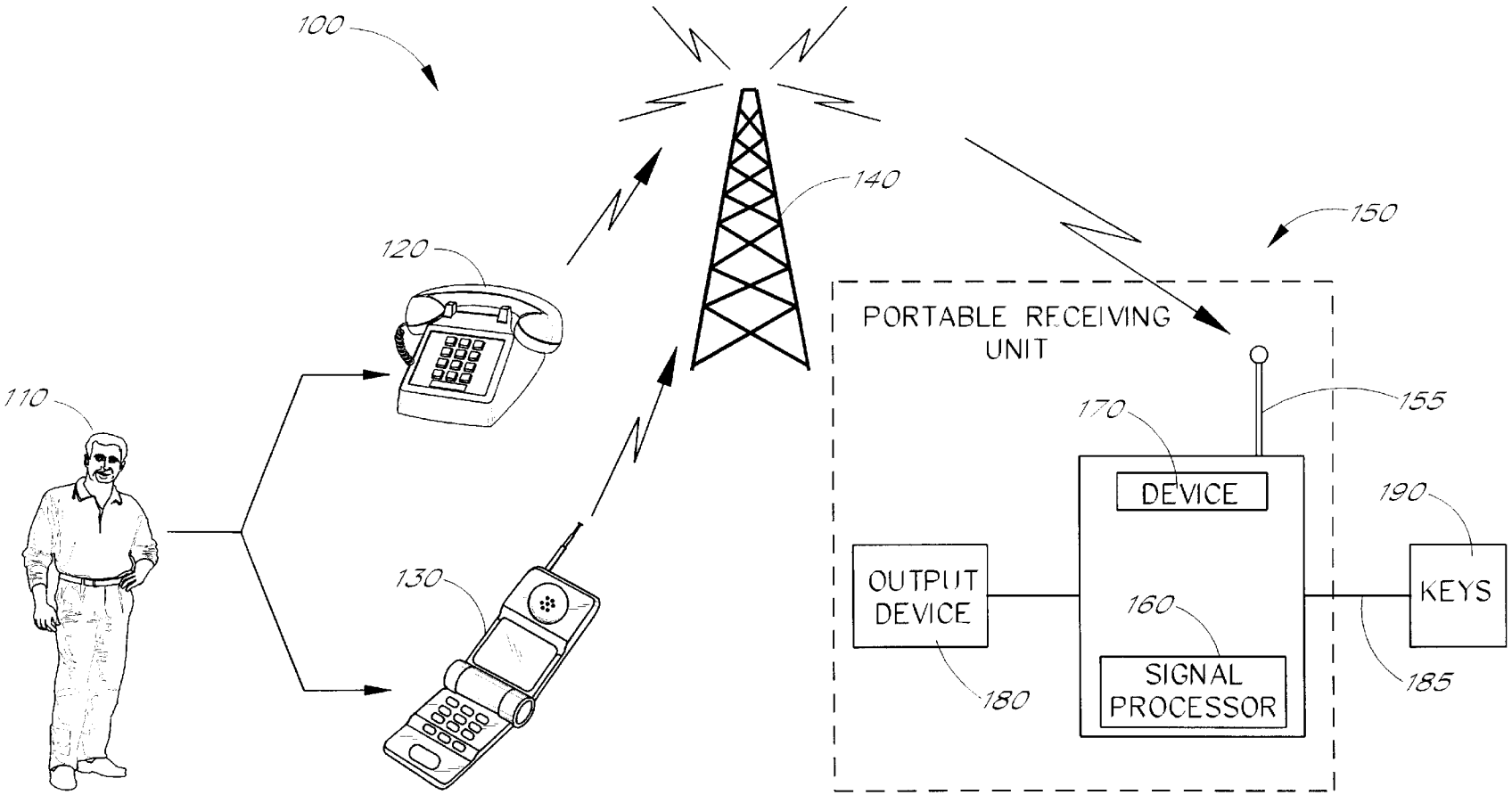
FIG. 1 is a schematic diagram of one embodiment of a system for locating a misplaced item.

FIG. 1 illustrates a system 100 in accordance with one embodiment of the present invention. An operator 110 uses a telephone 120 or 130 which is coupled via the public telephone system to a transmitting station 140 of a beeper or cellular telephone system. As discussed above, a beeper is defined to include pagers and any other portable device that can be activated by a user placing a telephone call. The transmitting station sends signals to a portable receiving device 150 which includes an antenna 155, a signal processor 160, a display 170, an output device 180, a battery (not shown), and external controls (not shown in FIG. 1). The receiving device 150 is coupled via a coupling link 185 which couples the receiving device 150 to an item 190, such as a set of keys, which may potentially be misplaced.

In this embodiment, the operator 110 uses the telephone 120 or 130 to dial a number to access the transmitting station 140. By inputting certain information either through voice or push button commands, the operator 110 customizes the data signal that the transmitting station 140 transmits. The transmitting station 140 sends a data signal to the receiving device 150. Transmission may also be accomplished by a network of transmitting stations as is well known in the art of wireless communication.

Such a scheme of transmitting an activation signal to the receiving device 150 has the advantage of a large activation range. In one embodiment, the activation range reaches everywhere that conventional cellular phone or beeper technology can reach. Furthermore, the activation signal, although initiated and programmed by the operator 110, is thereafter independent of the operator 110. This ensures that the activation signal is consistent, distinct and reliable since the activation signal is produced by electronic equipment as opposed to by the operator 110.

The receiving device 150 receives the data signal from the transmitting station 140 through its antenna 155 which may be internal or external. The receiving device 150 has a signal processor 160 which interprets the data signal from the antenna 155 so that the receiving device 150 may act accordingly. The display 170 on the receiving device 150 shows relevant information contained in the data signal. The signal processor 160 controls the output device 180. The output device 180 alerts the operator 110 as to the location of the missing item 190. This may be accomplished in a number of ways, such as, but not limited to, emitting sounds or flashing lights. The misplaced item 190 is coupled to the receiving device 150 so that the location of the misplaced item 190 is determined with the location of the receiving device.

Figure 2:
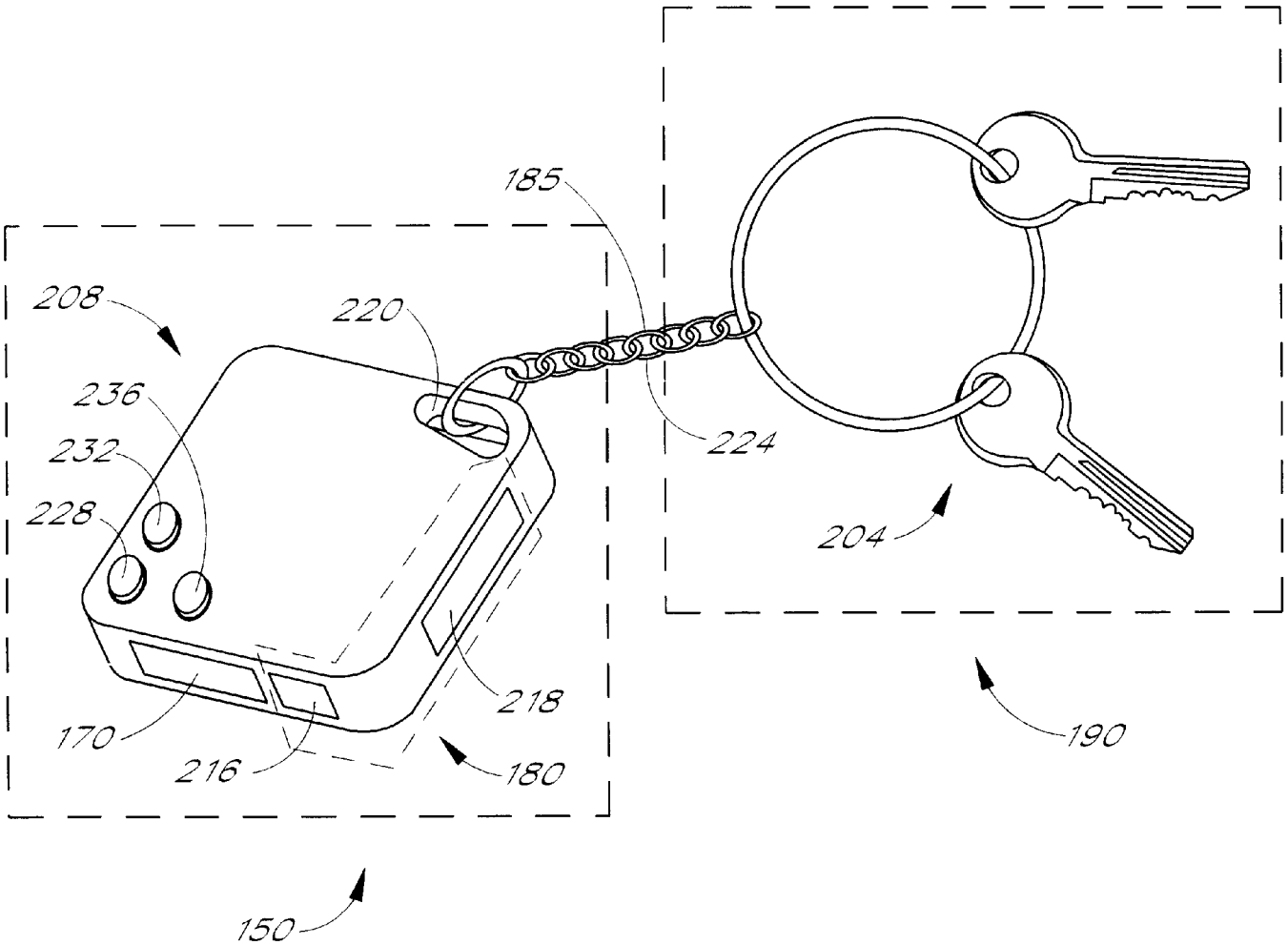
FIG. 2 is a schematic of one embodiment of a system for locating a set of keys.

FIG. 2 illustrates an embodiment in which the receiving device 150 is coupled to a set of keys 204 (the potentially misplaced item 190) by a key chain 224. The receiving device 150 for locating misplaced keys 204 comprises a water-resistant housing 208 in the form of a compact case. The housing 208 includes a display 170 and an output device 180. In one embodiment, the output device 180 is a flashing light 216. In another embodiment, the output device 180 is an audio speaker 218. In the preferred embodiment illustrated, the device includes both an audio speaker 218 and a flashing light 216. The housing 208 has a key chain receiving location 220. The set of keys 204 is held together on a typical key chain 224. The key chain 224 is coupled to the key chain receiving location 220. Furthermore, the housing 208 has control buttons 228–236.

In the preferred embodiment, the receiving device 150 is a modified hand-held beeper unit with all the typical beeper unit circuitry and features such as displaying and storing telephone numbers, short messages, and the time of day. These elements are well known in the art of wireless communication and are not discussed in detail. Because of well defined encoding and decoding procedures found in the art of beeper technology, the activation signal which is transmitted by the network of transmitting stations will cause the activation of only the particularly chosen receiver device 150. This reduces, if not effectively eliminates, the possibility of mistakenly receiving and reacting to the activation signal from another system, even if several operators attempting to activate their systems are all within the same activation range. Furthermore, because of the high degree of reliability of beeper receivers, there is very little risk of the device reacting to background noise or false signals.

In the preferred embodiment, the operator 110 who wishes to locate his or her set of keys will use the telephone 120 or 130 to dial a toll free number to ultimately reach a transmission station 140. The operator 110 then enters an identification code and security password before sending control data for manipulating the receiving device 150. The control data specifies whether the flashing light 216, the audio speaker 218, or both should be activated, as well as the volume level of the audio speaker 218 and the intensity or flashing rate of the flashing light 216. At the higher volume levels, the audio speaker 218 should be easily detected from distances greater than about thirty yards. The control data is received by the transmitting station 140 which then transmits a data signal to the receiving device 150. The receiving device 150 controls the output device 180 as determined by the data signal.

In one embodiment, after dialing a pre-determined telephone number, the operator 110 is connected with an automated menu of options that is activated by pressing phone buttons or speaking in answer to automated questions. In one menu, for example, the operator can specify the volume of the alarm emanating from the audio speaker on a scale from one to five where one is the quietest and five is the loudest level. Furthermore, the operator can specify the duration of the alarm, or can specify that the alarm volume initially be low and then increase as a function of time. In another option, the audio speaker 218 is set to emit a beeping sound synchronized with the flashing of the flashing light 216. In still another option, the receiving device 150 performs in its default pre-programmed mode.

After the operator 110 has located the receiving device 150 and the attached set of keys 204 or other item, the operator 110 turns off the output device 180. This is accomplished by pushing a button 228 located on the housing 208 of the receiving device 150. In the preferred embodiment, the buttons 228 and 236 also serve as typical buttons as used in a beeper unit. In such an embodiment, the device also acts as a fully functional beeper unit for receiving regular pages or messages. The buttons 228 and 236 further assist in programming the receiving device 150. The left button 228 is used to bring up various options in a menu as shown on the display 170. The right button 236 is used to select among the options in the menu. The other button 232 may be used to activate other functionalities of the output device 180.

The receiving device 150 may be programmed using the two buttons 228 and 236 so that the button 232, when pressed, turns on the light 216 in a continuous mode as a flashlight. The provision of a flashlight is useful, for example, for assisting the user in locating a keyhole at night.

The receiving device 150 may also be programmed using the two buttons 228 and 236 so that the button 232, when pressed causes the flashing light 216 to flash at great intensity and causes the audio speaker 216 to emit a siren sound at the highest volume setting. At this highest volume setting, the sound should be easily detectible at distances of at least about forty yards. In this mode, the receiving device 150 is employed as a personal protection alarm to alert attention to an operator 110 under attack or in a precarious position. In another embodiment, a separate large button (not shown in FIG. 2) is placed on the housing for this purpose.

Figure 3:
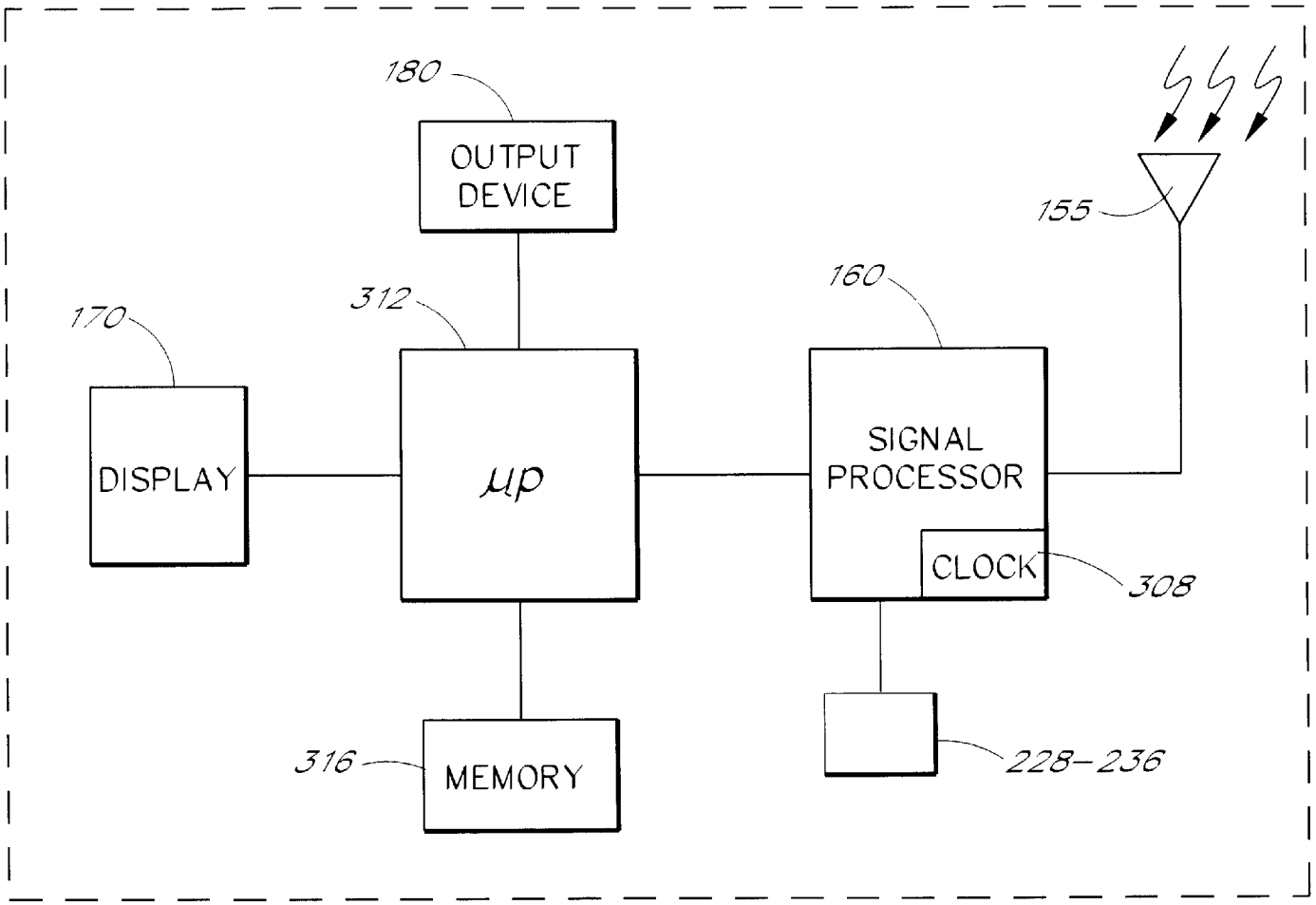
FIG. 3 is block schematic of one embodiment of the circuitry in a receiving device.

FIG. 3 shows a schematic of a block diagram of circuitry within one embodiment of the receiving device 150. An antenna 155 is coupled to a signal processor 160 with a clock 308. The signal processor 160 is coupled to a microprocessor 312. The microprocessor 312 is coupled to a memory storage device 316. The microprocessor 312 controls the output device 180 and the display 170. The buttons 228–236 as well as other external controls located on the outside housing 208 of the receiving device 150 are coupled to the microprocessor 312 through the signal processor 160.

An incoming data signal is received by the antenna 155 which routes the signal to the signal processor 160. The processed signal is directed to the microprocessor 312. The microprocessor 312 then interprets the processed signal to control the output device 180 as encoded by the processed signal. The microprocessor 312 during this process accesses the memory storage device 316 as required. For example, if the processed signal specifies that the microprocessor is to use a default mode of operating the output device 180, then the microprocessor accesses the memory storage device 316 in order to fetch the programmed default parameters. The buttons 228–236 as well as other external controls located on the outside housing 208 of the receiving device 150 when pressed send a signal which is received by the signal processor 160 which is coupled to the microprocessor 312, ultimately controlling the display 170 or the output device 180.

In an advantageous embodiment, the personal identification information of the operator 110 is stored in the memory storage unit 316. This information may become significant if the operator 110 becomes disabled, unconscious or incoherent and is taken to a hospital or police station. Emergency personnel such as police or medical staff have equipment which when activated sends a short range, special emergency medical signal which is received by the receiving device 150 on the person of the operator 110. Once the receiving device 150 receives the short range, special emergency medical signal, it commences an emergency medical mode by beginning to display all of the personal identification information stored in the memory storage unit 316. This information is displayed continuously and repeatedly unless the button 228 is pressed. Pressing the button 228 will pause the scrolling display at the current information being shown and pressing the button 228 again cause the scrolling display of information. The receiving device 150 gets out of emergency medical mode when it is taken out of the short range of equipment sending the emergency medical signal. The information may include, but is not limited to, the operator's name, address, telephone number, pertinent medical information and contact person information. Such information may be of critical importance in emergency situations.

In another advantageous embodiment, a toll free number inscribed on the back of the unit is useful if the keys are permanently lost or found by another person. The finder of the unit can call the 24-hour toll free number and corporate personnel will tell the finder the headquarters address and inform the finder that no postage is necessary to send the keys back to corporate headquarters. In another embodiment, the user can remotely activate the device to cause a preprogrammed message, such as a reward message, to appear continuously on the display 170.

Another advantageous embodiment includes a voice dictation unit. In such an embodiment, the device construction of FIGS. 2 and 3 is modified slightly. The audio speaker 218 area is modified to add a microphone which connects to the signal processor 160. Furthermore, extra external dictaphone controls are added to the housing 208. Instead of a micro-cassette, digital memory is utilized adding extra functionality to the already present memory storage device 316.

Still another advantageous embodiment includes a short-range transmitter which transmits using the already present antenna 155. With a transmitter, the functionality of, for example, a garage door opener or a car door controller may be provided. The transmitter can be set by the manufacturer or if the range of transmitted frequencies is limited can be programmed accordingly. The signal data necessary to open a garage door or lock or unlock a car door is stored in the memory storage device 316, preferably by an authorized dealer. The transmitting circuitry and encoding required for a garage door opener or a car door controller are well known in their respective arts and although incorporated into the present embodiment are not discussed here.

Furthermore, the added functionality of a garage door opener or a car door controller can take full advantage of the extra measure of security that remote accessibility can provide. Thus, upon losing or misplacing the device, an operator 110 would be able to disable the garage door opener or car door controller features by placing a phone call and choosing from among the appropriate automated menu options. Accordingly, upon location of the device, the operator 110 could enable the garage door opener or car door controller features by the same method.

In yet another advantageous embodiment, all of the features disclosed herein are incorporated into a single device for convenience, economy, and safety. The receiver device 150 in such an embodiment operates as a lost item locator, a beeper, a digital clock, a flashlight, a personal protection siren, an emergency information resource, a voice dictation unit, a garage door opener, and a car door controller.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. The method for locating a misplaced item comprising the steps of:

attaching the item to a portable sound generation unit, the sound generation unit including circuitry adapted to operate within a beeper network to enable a user to activate the sound generation unit by using a telephone;

remotely activating the sound generation unit through the beeper network when the item is misplaced to cause the sound generation unit to create an audible signal of sufficient volume to enable a user to locate the sound generation unit when the user is positioned remotely from the item; and using the audible signal to locate the sound generation unit and the attached item, said step of remotely activating the circuit of the sound generation comprising the step of:

calling from a telephone and choosing from a plurality of programmable options from an automated menu, the step of choosing including the step of selecting a volume setting for the audible signal.

* * * * *